United States Patent [19]

Merges

[11] 4,316,476

[45] Feb. 23, 1982

[54] FLAT CURLER TO CURL OR UNDULATE HAIR

[75] Inventor: Marco Merges, Cologne, Fed. Rep. of Germany

[73] Assignee: Heinz Merges, Cologne, Fed. Rep. of Germany

[21] Appl. No.: 133,311

[22] Filed: Mar. 24, 1980

[30] Foreign Application Priority Data

Apr. 7, 1979 [DE] Fed. Rep. of Germany ... 7910247[U]
Sep. 25, 1979 [DE] Fed. Rep. of Germany ..... 2938701

[51] Int. Cl.[2] ..... A45D 2/00
[52] U.S. Cl. ..... 132/40
[58] Field of Search ..... 132/34, 39, 40, 41, 132/42, 43 R

[56] References Cited

U.S. PATENT DOCUMENTS

| | | | |
|---|---|---|---|
| 2,264,356 | 12/1941 | Berg | 132/34 R |
| 2,289,446 | 7/1942 | Mearo | 132/34 R |
| 2,631,593 | 3/1953 | Madore | 132/38 R |
| 2,809,645 | 10/1957 | Frakes et al. | 132/42 |
| 2,906,273 | 9/1959 | Beauregard | 132/43 R |
| 3,108,603 | 10/1963 | Mobberley | 132/40 X |
| 3,707,155 | 12/1972 | Lembery | 132/40 |
| 3,943,946 | 3/1976 | Gallegos | 132/39 |

*Primary Examiner*—G. E. McNeill
*Attorney, Agent, or Firm*—Dille, Ramik & Wight

[57] ABSTRACT

A flat curler is designed for curling or undulating hair. The flat curler comprises a round bar having a bigger diameter at its ends than in its center part and an elastic band is connected to its one end to serve as a hair fixture means. A cylindrical sleeve is fitted to be longitudinally displaceable on the round bar from one end to the other. This sleeve has a longitudinal slot which is open-ended at the advance end of the sleeve. The longitudinal slot is substantially straight and axis parallel over at least the major part of the length of the sleeve. Further the longitudinal slot is closed over its total length by an overlapping edge portion that is directed opposite to the direction of the wound hair.

15 Claims, 16 Drawing Figures

FIG. 1
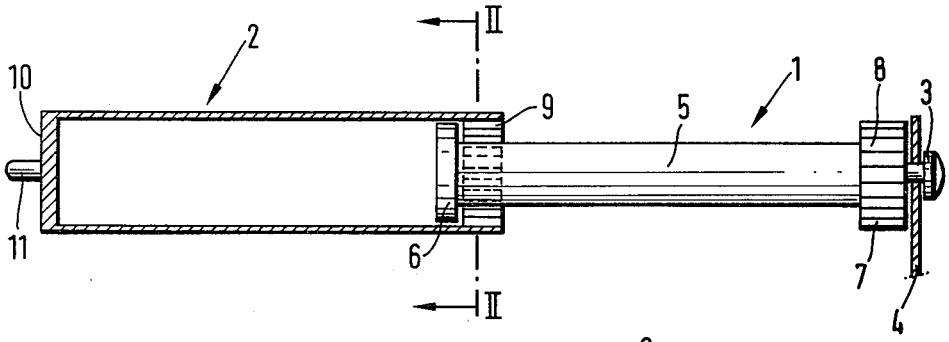
FIG. 2
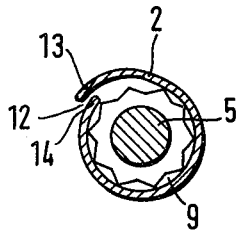
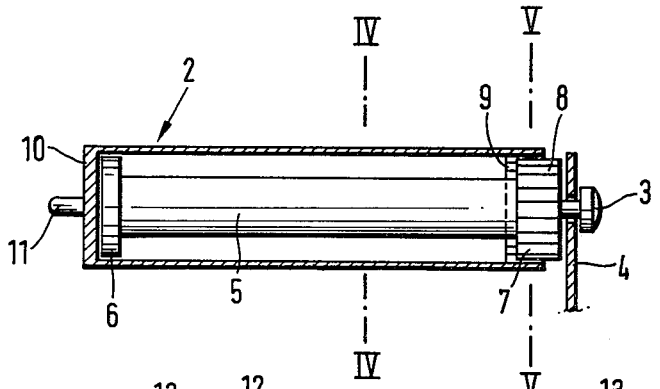
FIG. 3
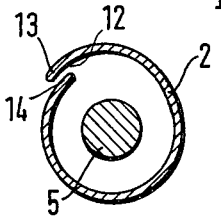
FIG. 4
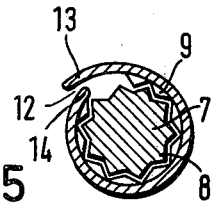
FIG. 5

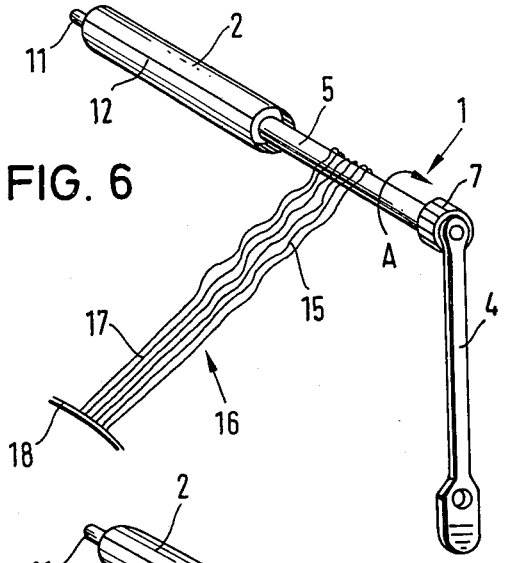
FIG. 6
FIG. 7
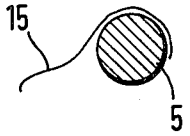
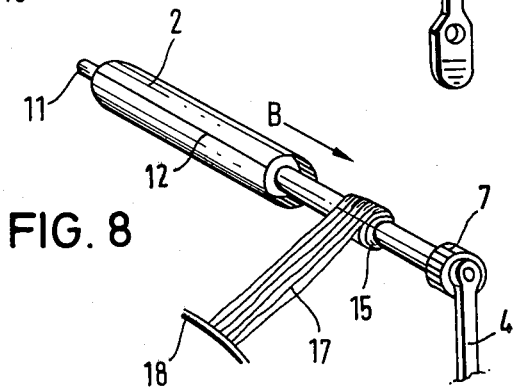
FIG. 8
FIG. 9
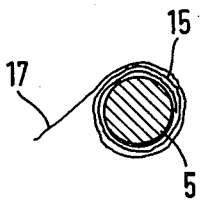
FIG. 10
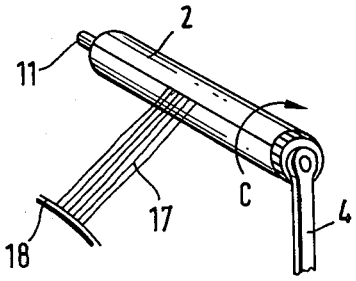
FIG. 11
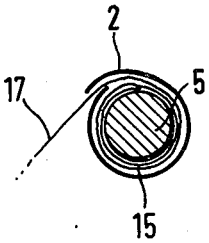
FIG. 12
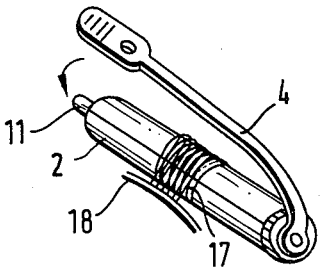
FIG. 13
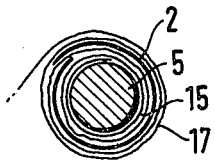

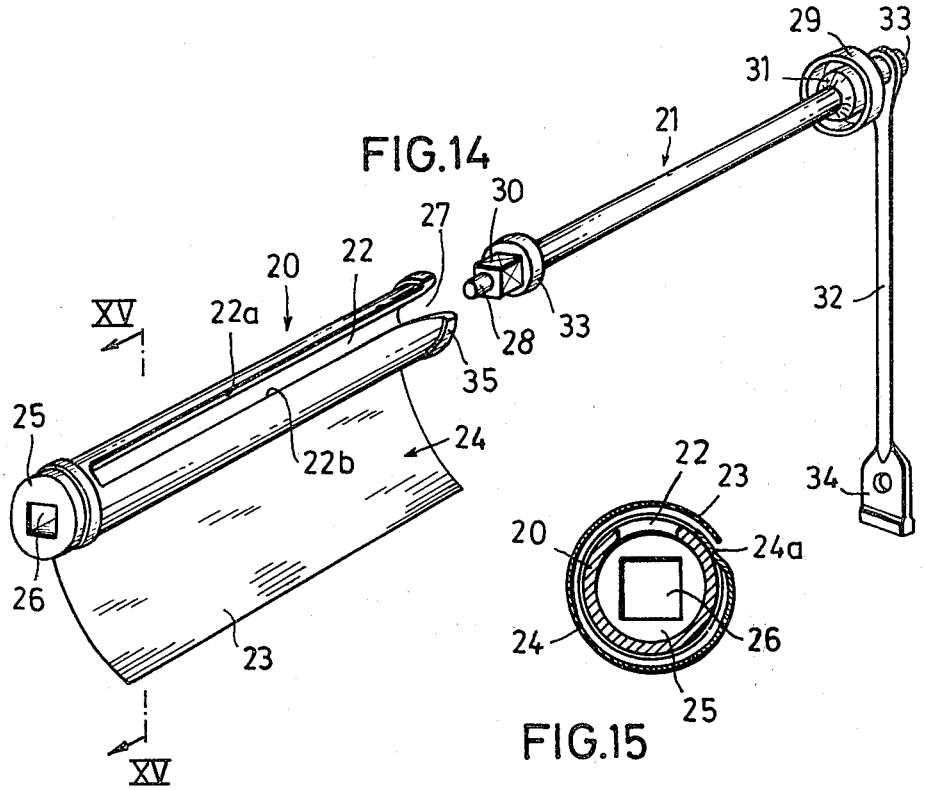
FIG.14
FIG.15
FIG.16
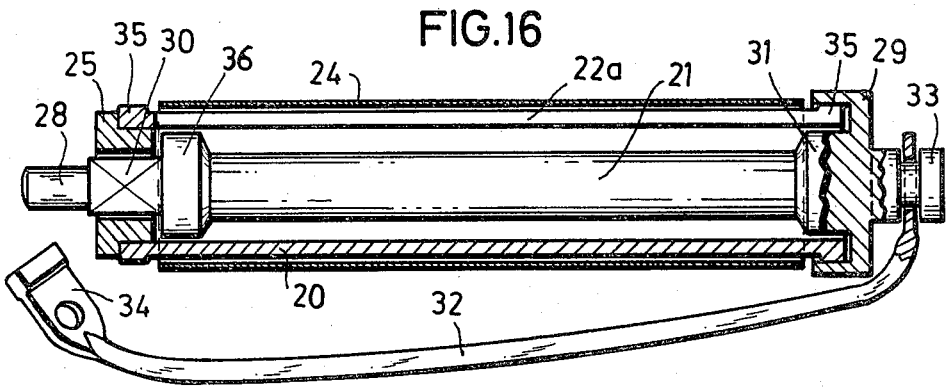

FLAT CURLER TO CURL OR UNDULATE HAIR

The invention relates to a flat curler to curl or undulate hair comprising a round bar having a bigger diameter at its ends than in its center part and an elastic band connected to one end and serving as a fixture means for the hair.

A lock of hair wound about such a flat curler from its top to the scalp shall be subsequently treated with a permanent wave preparation, which is applied to the wound hair e.g. by dabbing, and it penetrates from the outer hair portion on the round bar near the head towards the hair ends disposed internally on the round bar. However, this is frequently undesirable because a perm first becomes less strong in the region near the head due to the hair growing out of the scalp, while it is still sufficiently strong at the ends of the hair so that a perm treatment of the ends would be necessary only at a later date. It being impossible with the known flat curlers to apply the perm preparation only to the hair portions near the head and to shield the ends of the hair from the perm preparation, the ends are more frequently subjected to the chemical treating agent than required.

Practice has shown that the hair ends, due to their compulsory concomitant treatment during curling or undulating of the hair-line are exposed about five times more often to chemical influences than necessary for the hair end portions. As a result, the hair ends are strongly attacked by the undulating agent and they may break off, split or lose their gloss and suffer from other detrimental damages.

It is the object of the invention to provide a flat curler for curling or undulating hair so that it is possible to shield the end portions of a hair strand from the influence of an undulating agent or the like and to only treat with the preparation the strand portions near the scalp.

The problem is solved in case of a flat curler of the mentioned type by means of a cylindrical sleeve arranged on the round bar to be longitudinally displaceable from one end to the other and which comprises a longitudinal slot open-ended at the advance end of the sleeve.

The round bar and the sleeve may be separable from each other or protected against a complete separation so that they form one unit. Separability of both parts involves the advantage of allowing to use sleeves of different diameters with one round bar so that an adaptation to long and short hair under treatment is possible this way.

When operating with the flat curler, the sleeve is first removed as far as possible or completely from the round bar, and on the central part of the bar, the ends still curled of a strand of hair are wound. Upon reaching the smooth hair portion near the scalp, the sleeve is pushed over the round bar with the wound up hair ends so that the hair may pass through the longitudinal slot. In the final position of the sleeve the hair ends wound about the round bar are tightly enclosed by the sleeve. By further turning the flat curler the portion near the scalp of the hair strand is wound on the sleeve and upon reaching the scalp, the flat curler is fixed on the head by putting over it the flexible band to attach its free end at the flat curler on the head. When the undulating agent or the like is applied, only the hair portion wound about the sleeve is under the influence of the preparation. The hair portion within the sleeve is protected against the preparation and is not affected by it. Upon termination of the perm process the sleeve is removed from the round bar and the strand of hair may be subjected, as a whole, to another treatment on the round bar, or the round bar is removed from the wound up strand upon detaching the elastic band.

The portion of the strand of hair enclosed during the treatment by the liquid-impermeable sleeve is shielded from the preparation so that it cannot be affected by it. Thus, this portion of hair is not necessarily treated with the hair line but it is intentionally treated only at the moment when said hair portions call for a new perm treatment. Due to the differentiated treatment possible by simple means with the aid of the flat curler hair is carefully handled and maintained in a good state of health.

The rear end of the continuous sleeve of liquid-tight material is advantageously closed by a bottom portion. As a result, there is formed a sheath protecting the round bar to the outside. This effect is still increased in that the longitudinal slot is closed over its total length by an overlapping edge portion, the overlapping being opposite to the direction of wound hair. When the sleeve is made of a somewhat flexible material the overlapping portion is pressed against the sleeve jacket when hair is wound about it and the longitudinal slot is tightly closed.

In an advantageous embodiment of the invention, the edges of the longitudinal slot of a rigid sleeve are in spaced relationship side-by-side and the overlapping edge portion forms part of a flexible flap whose other edge is secured to the outer surface of the sleeve. To facilitate sliding of the sleeve on the hair-covered round bar, the open end of the longitudinal slot conveniently forms a wedge-shaped enlargement.

For the detachable fixing of the free end of the elastic band, an axial pin may be provided which is attached to the bottom portion or to the one end of the round bar and which projects through one aperture in the bottom portion of the sleeve to the outside. For the rotating connection of the round bar integral with the sleeve to facilitate handling, the profile of the pin should have edges so as to be disposed in the correspondingly profiled opening in the bottom portion. The profile may be square.

Alternatively, to avoid a relative rotation between the round bar and the sleeve, profiles may be provided at least at one end on the internal periphery of the sleeve to match with corresponding profiles on the outer periphery of at least one thicker round bar end. It is suitable to provide longitudinal corrugations or the like on the periphery as profiles. With a sleeve comprising a bottom portion, only its open end should be internally corrugated to cooperate with a corresponding corrugation on the one end of the round bar having the bigger diameter. The other end of the round bar, having the bigger diameter may be non-profiled to form with the internal corrugation at the open sleeve end an extraction stop.

The open end of the sleeve is closed by the engagement of the profiles with flat curler elements fitted into one another. In the mentioned embodiment with the torsion protection in the bottom portion the internal wall of the sleeve is smooth and void of projections so that the round bar may be removed completely out of the sleeve. For the liquid-tight closure of the sleeve, one end of the round bar is provided with a cap mountable on the sleeve opening.

Alternatively, the sleeve jacket may be liquid-permeable by means of perforations and both ends of the sleeve may be open. This embodiment of the flat curler allows to include the outer hair ends in the permament wave treatment procedure because the preparation may enter through the sleeve jacket, the open rear sleeve end and the longitudinal slot into the sleeve inside to act on the hair ends wound about the round bar. As a result, the hair ends are weakly curled additionally and the hair line is intensely treated so that, in the final hairdressing, the ends are curled more closely and the hairline is wide-curled.

In the drawing embodiments of the invention are shown schematically.

FIG. 1 is a partly longitudinal section of an open flat curler,

FIG. 2 is a cross section along line II—II in FIG. 1,

FIG. 3 is a partly longitudinal section of a closed flat curler,

FIG. 4 is a cross section along line IV—IV in FIG. 3,

FIG. 5 is a cross section along line V—V in FIG. 3,

FIGS. 6 and 7 show a perspective view and cross section re the initial stage of hair curling on a flat curler during a permanent treatment, FIGS. 8 and 9 show a perspective view and cross section of the continued curling stage of the hair, FIGS. 10 and 11 show a perspective view and cross section of the closed flat curler with the beginning curling about the sleeve and FIGS. 12 and 13 show the termination of curling in a perspective view and cross section.

FIG. 14 is a changed embodiment of the invention, the sleeve and the round bar being completely separated from each other, FIG. 15 is a cross section along line XV—XV in FIG. 14 and FIG. 16 is a longitudinal section of a telescoped flat curler.

The flat curler substantially comprises a round bar 1 of plastic or the like to which a smooth cylindrical sleeve 2 of somewhat flexible, however substantially nondeformable material is connected inseparably but displaceably in longitudinal direction. By means of a button 3, the round bar 1 is connected to an elastic band 4 as a hair fixing means. The major part of the length of the round bar is smooth or optionally slightly rough, and to said central portion 5 the ends 6 and 7 having a bigger diameter are joined. The end 6 is a disk having a non-profiled periphery and a diameter adapted to the smooth internal diameter of sleeve 2 so that with an axial displacement of members 1 and 2 relative to each other, it freely slides in the sleeve. End 7 is also a disk, which, however, on its outer periphery is provided with longitudinal corrugations 8 distributed circumferentially. When the flat curler is telescoped together (FIG. 3) the corrugation 8 coacts with a corresponding corrugation 9 on the internal circumference of the advance end of the sleeve 2 so that the bar 1 and the sleeve 2 are rotatingly connected integrally. In addition, the corrugation 9 of the sleeve 2 forms in common with the non-corrugated end 6 of bar 1 an extraction stop for the latter, so that the parts are permanently interconnected, thus facilitating handling of the flat curler.

In place of the crown of a corrugation profile, one sole rib may be fitted in the sleeve inside or on the periphery of one of the two bar ends which engage with a groove on the other part to avoid the relative movement of bar and sleeve.

At the rear end of sleeve 2, there is designed a bottom portion 10 which closes the sleeve like a bag, and which is provided with a pin 11 directed to the outside. Said pin 11 serves for receiving an eye portion of the elastic band 4 for the fixture of the flat curler on the head. The sleeve 2 comprises a longitudinal slot extending to the bottom portion 10 and the straight longitudinal slot 12 is open-ended at the advance end of sleeve 2. The sealing of the inner space of sleeve 2 is favored by the fact that the one edge 13 of the longitudinal slot 12 overlaps its other edge 14 in opposite direction of the wound hair. Accordingly, when the strand of hair is wound about the sleeve 2, the overlapping edge 13 is pressed against the underlying edge 14.

According to the Example of FIGS. 8 to 13 illustrating schematically a permanent wave treatment, the sleeve 2 is first removed from the round bar 1 until its inner profile 9 abuts against the disk end 6 of the bar 1 and the extracting movement is terminated. The central, preferably cylindrical portion 5 having a reduced diameter is now covered with the still curly end portion 14 of a strand of hair 16, the flat curler being rotated in direction of arrow A (FIGS. 6 and 7). Upon winding up the curled end 15, the sleeve 2 is pushed over the central portion 5 of the round bar in direction of arrow B, the strand of hair passing through the longitudinal slot 12 of sleeve 2 (FIGS. 8 and 9). As soon as the sleeve 2 is mounted rotatingly integral with the round bar 1 by the intermeshing of profiles 8 and 9, the uncurled portion 17 of the strand of hair to be subjected to the permanent wave treatment is wound about the sleeve in that the closed flat curler is rotated in direction of arrow C (FIGS. 10 and 11). The hair 17 wound about the sleeve 2 closes the longitudinal slot 12 by pressing the overlapping 13 against the underlying edge 14.

Upon termination of the winding, i.e. after the hair portion 17 has been wound up until the flat curlers rests on the scalp 18, the elastic band 4 is applied on the pin 11 of the flat curler. Now, the hair portion 17 can be exposed to the permanent wave treatment, while the hair ends 15 tightly surrounded by the sleeve 2 are excluded from said treatment.

In a modified embodiment of the invention, the bar 1 may have an optional different shape, on the proviso that the central portion has a diameter inferior to that of the two ends so as to permit to slide more easily into the cylindrical sleeve the bar covered with the wound hair. The locking profiles at the bar and at the internal sleeve periphery may also have another shape.

If it is intended that the hair portion wound about the bar shall slightly participate in the treatment applied to the hair portion wound about the sleeve, the sleeve jacket is designed to be liquid-permeable e.g. in that the sleeve is provided with perforations or it is made of a sieve-like material, that the longitudinal slot remains unclosed and the sleeve ends are left open.

In the example of FIGS. 14 to 16, a round bar 21 and a cylindrical sleeve 20 axially slidable thereover are of a design different from the first embodiment and they may be completely separated from each other.

A sleeve 20 of rigid material is closed at its one end by means of an inserted or specially formed bottom portion 25, its other end being open. Behind the bottom portion 25, there begins a longitudinal slot 22 whose edges **22*a* and 22*b* extend in parallel at a relatively big distance and diverge in a wedge-shape at the open sleeve end. At both ends of the sleeve 20 there are provided annular beads 25. In the sleeve area between the two annular beads, there extends a flap 24 of flexible material whose one edge is secured to the outer surface of the sleeve 20 at 24***a* (FIG. 15) and whose free edge 23 partly overlaps the longitudinal slot 22. In the illustrated example, the flap 24 surrounds the total sleeve 20. This is not absolutely necessary. When the fixing line 24*a* on the sleeve periphery is offset, a shorter flap 24 also achieves an overlapping of the longitudinal slot 22 of the sleeve.

In the bottom portion 25 of the sleeve 20, there is provided a square opening 26 for the receipt of a corresponding square profile 30 at one end of a round bar 21 passed therethrough. If the square profile 30 is passed into the square opening 26, an axial pin 28 at the round bar 21 projects beyond the bottom portion 25 to the outside. This pin 28 serves for suspending a perforated end 34 of an elastic band 32 whose other end is secured to a constricted pivot 33 of the round bar 21.

Behind the pivot 33, a cap 29 is connected to the round bar 21 to cause a liquid-tight closure of the sleeve aperture in common with a concentric core 31. (FIG. 16). At the end of the round bar 21 opposite to the cap 29, the round bar has an annular portion 33 behind the square profile 30. Said annular portion shall prevent the hair curled about the round bar 21 from sliding, and, moreover, it shall facilitate the introduction of the round bar into the sleeve 20. Furthermore, it is an indication to the diameter of the hair curler admissible at a maximum in order to still fit into the sleeve 20.

The inner space of the sleeve being free of any projections, the sleeve 20 can be completely separated from the round bar 21 thus facilitating handling of the flat curler. Additionally, it is possible to use sleeves of different diameters with the round bar 21 in adaptation to the length of the hair under treatment.

What is claimed is:

1. A hair curler comprising an elongated bar having a medial portion and opposite end portions, said elongated bar medial portion being adapted to have first wound thereon first portions of strands of hair disposed remote from a persons scalp, a band having axially opposite end portions, a tubular sleeve defined by a tubular wall into which is telescopically slideably received through an open end portion thereof at least one of said elongated bar opposite end portions, a longitudinal slot in said tubular sleeve wall opening axially through said tubular sleeve wall open end portion whereby unwound second portions of said strands of hair can be slid axially into said longitudinal slot through said axial opening thereof and thereafter said second strand portion can be wound about said tubular sleeve, said band including means for cooperatively interconnecting said elongated bar and said tubular sleeve, and flexible flap means carried by said tubular sleeve for circumferentially overlapping said longitudinal slot in its entirety and for having wound thereupon said second strand portion.

2. The hair curler as defined in claim 1 wherein said flexible flap means is an integral extension of said tubular sleeve wall in overlapping relationship to an edge of said tubular sleeve wall which at least in part defines said longitudinal slot.

3. The hair curler as defined in claim 1 wherein said longitudinal slot is defined by a pair of longitudinal edges, said flexible flap means being a flap joined to said tubular sleeve in spaced relationship to said edges, and said flap having a circumferential length sufficient to span and overlap said slot including the longitudinal edges thereof.

4. The hair curler as defined in claim 1 including first and second corrugation means disposed respectively internally and externally of said respective tubular sleeve wall and said bar for slidably interengaging upon said bar being telescoped within said tubular sleeve and for preventing relative rotation therebetween.

5. The hair curler as defined in claim 1 including interengageable male and female socket means disposed respectively on and in said bar and tubular sleeve for slidably interengaging upon said bar being telescoped within said tubular sleeve and for preventing rotation therebetween.

6. The hair curler as defined in claim 2 including first and second corrugation means disposed respectively internally and externally of said respective tubular sleeve wall and said bar for slidably interengaging upon said bar being telescoped within said tubular sleeve and for preventing relative rotation therebetween.

7. The hair curler as defined in claim 3 including interengageable male and female socket means disposed respectively on and in said bar and tubular sleeve for slidably interengaging upon said bar being telescoped within said tubular sleeve and for preventing rotation therebetween.

8. The hair curler as defined in claim 1 including first sealing means for sealing said tubular wall opposite said open end portion, and second sealing means for sealing said tubular wall at said open end portion.

9. The hair curler as defined in claim 8 wherein said first sealing means is an end wall of said tubular sleeve.

10. The hair curler as defined in claim 8 wherein said second sealing means includes a cap carried by another of said elongated bar opposite end portions which closes said open end portion.

11. The hair curler as defined in claim 8 wherein said second sealing means is a disk carried by said elongated bar, and a perpheral surface of said disk is in internal contiguous relationship to an inner surface of said tubular wall adjacent said open end portion.

12. The hair curler as defined in claim 8 wherein said first sealing means includes an end wall of said tubular sleeve having an aperture therein, and said elongated bar one end portion seats in said aperture.

13. The hair curler as defined in claim 9 wherein said second sealing means includes a cap carried by another of said elongated bar opposite end portions which closes said open end portion.

14. The hair curler as defined in claim 9 wherein said second sealing means is a disk carried by said elongated bar, and a peripheral surface of said disk is in internal contiguous relationship to an inner surface of said tubular wall adjacent said open end portion.

15. The hair curler as defined in claim 10 wherein said second sealing means is a disk carried by said elongated bar, and a peripheral surface of said disk is in internal contiguous relationship to an inner surface of said tubular wall adjacent said open end portion.

* * * * *